United States Patent [19]

Hagel et al.

[11] Patent Number: 4,901,637

[45] Date of Patent: Feb. 20, 1990

[54] EQUIPMENT IN THE SYSTEM OF ROLLS IN A SUPERCALENDER

[75] Inventors: Rauno Hagel, Järvenpää ; Wilhelm Landin, Ohkola, both of Finland

[73] Assignee: Valmet Paper Machinery Inc., Helsinki, Finland

[21] Appl. No.: 283,985

[22] Filed: Dec. 13, 1988

[30] Foreign Application Priority Data

Jan. 13, 1988 [FI] Finland ..... 880137

[51] Int. Cl.[4] ..... B30B 3/04

[52] U.S. Cl. ..... 100/170; 100/47; 100/162 R; 100/163 R; 100/168; 100/169

[58] Field of Search ..... 100/35, 47, 168, 169, 100/170, 163 R, 163 A, 161, 162 R; 29/116.2, 113.2; 72/240, 243, 245, 247

[56] References Cited

U.S. PATENT DOCUMENTS

| | | | |
|---|---|---|---|
| 3,060,843 | 10/1962 | Moore et al. | 100/170 X |
| 3,373,681 | 3/1968 | Jaegers | 100/170 X |
| 4,380,954 | 4/1983 | Edele | 100/170 X |
| 4,434,713 | 3/1984 | Hartwich et al. | 100/170 X |
| 4,501,197 | 2/1985 | Karr et al. | 100/47 X |
| 4,510,859 | 4/1985 | Berry | 100/47 X |

FOREIGN PATENT DOCUMENTS 2423504 11/1975 Fed. Rep. of Germany ..... 100/168

*Primary Examiner*—Harvey C. Hornsby
*Assistant Examiner*—Stephen F. Gerrity
*Attorney, Agent, or Firm*—Dellett, Smith-Hill, and Bedell

[57] ABSTRACT

The invention concerns an equipment in the system of rolls in a supercalender for equalizing the profiles of linear loads between the rolls. In the normal way, the system of rolls comprises an upper roll, a lower roll, several intermediate rolls placed between the upper roll and the lower roll, as well as lifting spindles (40) placed at both sides of the system of rolls. The equipment in accordance with the invention comprises lightening devices (10) acting upon the bearing housing (38) at each end of at least one roll, the lightening devices being arranged to eliminate the distortions caused by the weight of the bearing housings (38) and the auxiliary devices attached to same in the lateral areas of the profiles of linear load between the rolls. The lightening devices (10) are provided between brackets (39) or equivalent attached to the bearing housings of the roll and spindle nuts (44) mounted on the lifting spindles (40) and placed underneath the brackets so as to lift the bearing housings (38) while resting on the spindle nuts (44).

13 Claims, 4 Drawing Sheets

EQUIPMENT IN THE SYSTEM OF ROLLS IN A SUPERCALENDER

BACKGROUND OF THE INVENTION

The invention concerns equipment in the system of rolls in a supercalender for equalizing the profiles of linear loads between the rolls, said system of rolls comprising an upper roll, a lower roll, several intermediate rolls placed between the upper roll and the lower roll, as well as lifting spindles placed at both sides of the system of rolls.

The system of rolls in a conventional supercalender comprises a number of rolls, usually 8 to 14 rolls, which are arranged one above the other as a stack of rolls. The rolls placed one above the other are in nip contact with each other, and the paper web to be calendered is arranged to run through the nips between the rolls. The rolls in the system of rolls are mounted rotatably in bearing housings, which are provided with fastening brackets that are fitted as freely gliding on vertical lifting spindles. Thus, one of the functions of the lifting spindles is to act as guides so as to keep the rolls in the system of rolls in the correct position. Thus, the bearing housings of the rolls in the system of rolls are not fixed rigidly to the calender frame, but the bearing housings, and consequently also the rolls, can move vertically. Since the masses of the bearing housings of the rolls and of the auxiliary devices attached to same are quite large, in conventional supercalenders this causes the considerable drawback that said masses of the bearing housings and of the auxiliary devices attached to same cause distortions in the distributions of the linear loads in the nips between the rolls. Thus, the linear load in the nips is not uniform, but it is substantially higher at the ends of the nips than at the middle. Since in the systems of rolls of supercalenders there are several rolls placed one above the other, as was already stated above, this further results therein that the faults in the linear loads in individual nips are cumulated and cause a considerably large error in the overall linear load. This defective distribution of the linear load deteriorates the quality of the calendered paper.

So far, attempts have not been made to find a solution for the problem described above, and this is why the object of the present invention is to provide an equipment by means of which it is possible to eliminate the errors in the profiles of the linear loads in the nips which are caused by the masses of the bearing housings of the rolls in the system of rolls and by the masses of the auxiliary devices attached to the bearing housings. From conventional machine calenders, a solution is known in prior art wherein the rolls of the machine calender are provided with a lightening system, in particular with hydraulic lightening cylinders for elimination of concentrated loads arising from the bearing housings of the rolls and from auxiliary devices. It is a simple matter to provide machine calenders with such relief devices, because the rolls in the system of rolls of a machine calender are mounted on the frame of the calender by the intermediate of levers with articulated joints. It would be very difficult and even impossible to use devices corresponding to the machine calenders in supercalenders because of the constantly varying diameters of the fibre rolls and of the large number of rolls in supercalenders.

SUMMARY OF THE INVENTION

Thus, the specific object of the present invention is to provide an equipment by means of which the distortions, caused by the bearing housings of the rolls in the system of rolls in a supercalender and by auxiliary devices attached to said bearing housings, in the nip profiles in the system of rolls are eliminated. In view of achieving this, the invention is characterized in that the equipment comprises lightening means acting upon the bearing housing at each end of at least one roll, said lightening means being arranged to eliminate the distortions caused by the weight of the bearing housings and the auxiliary devices attached to same in the lateral areas of the profiles of linear load between the rolls.

It can be considered the most important advantage of the invention that, since the profiles of linear loads in the nips of the system of rolls can be made uniform, by using the equipment in accordance with the invention the quality of the calendered paper can be made better and more uniform across the entire width of the paper web.

BRIEF DESCRIPTION OF THE DRAWINGS

In the following, the invention will be described in more detail with reference to the figures in the accompanying drawing.

DETAILED DESCRIPTION

Figure 1A:
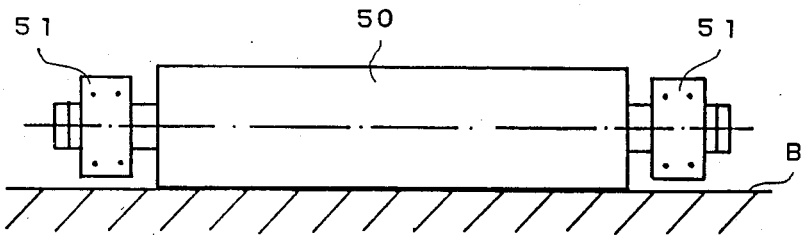
FIGS. 1A, 1B and 1C are schematical illustrations of the effect of the equipment in accordance with the invention on the profile of linear load.
Figure 1B:
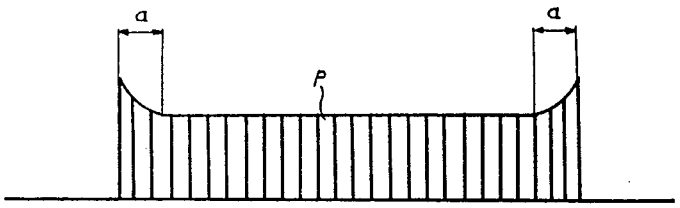
Figure 1C:
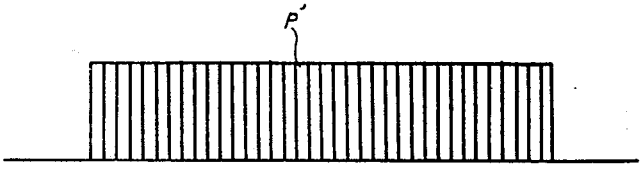

FIG. 1A is a schematical illustration of a roll 50 provided with bearing housings 51 and lowered on a plane base B. FIG. 1B shows the profile of the linear load of a roll 50 as shown in FIG. 1A. As can be seen from FIG. 1B, the linear load produced by the roll 50 is not uniform, but the masses of the bearing housings 51 and of auxiliary devices attached to them, if any, cause that the linear load p is higher in the lateral areas a of the nip than at the middle. In conventional supercalenders, the linear loads in the nips in the system of rolls are formed exactly in accordance with FIG. 1B. However, since the system of rolls in a supercalender comprises a number of rolls, usually 8 to 14 rolls placed one above the other, thereat the errors in the linear loads of the individual nips are cumulated and cause a remarkably large error in the overall linear load. Thus, in view of the quality of the paper, it would be highly advantageous if the faults in the linear loads resulting from the masses of the bearing housings and of auxiliary devices attached to same could be eliminated, in which case a uniform profile of linear loads in accordance with FIG. 1C could be formed in the nips in the system of rolls, said profile being denoted with the reference p'.

Figure 2:
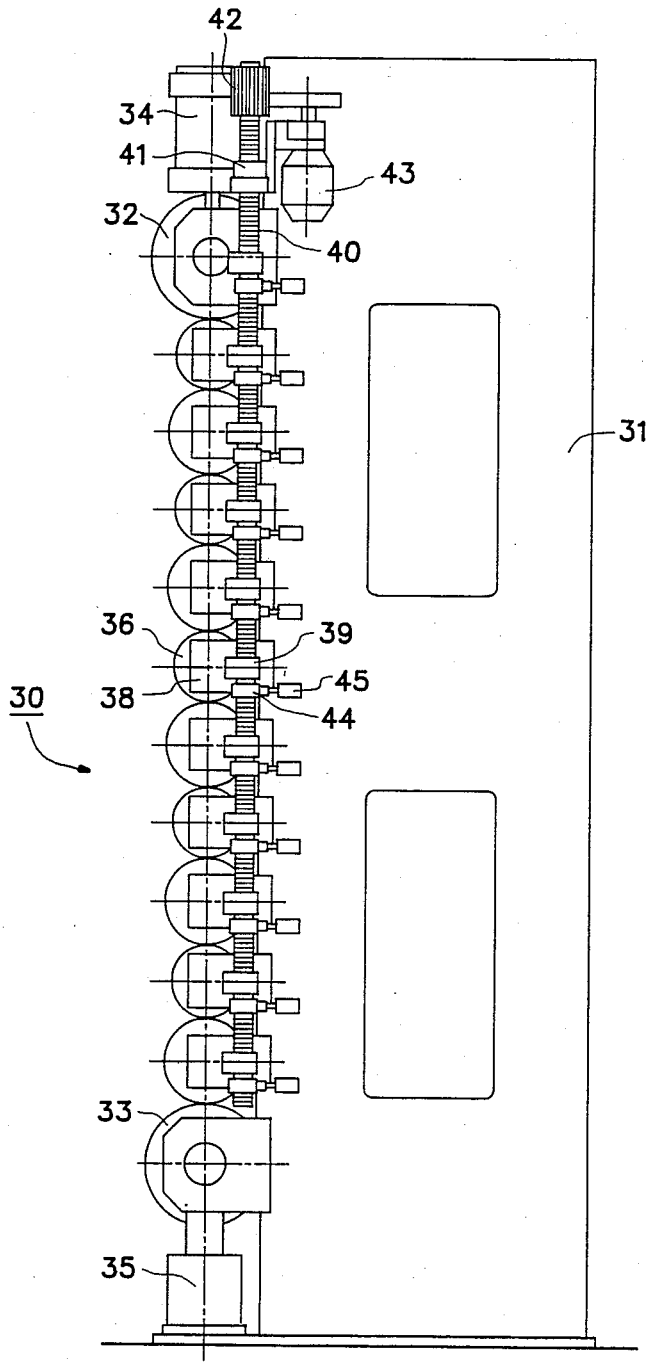
FIG. 2 is a schematical side view of a system of rolls of a supercalender to which the equipment in accordance with the invention can be applied.

FIG. 2 is a schematical side view of the system of rolls 30 of a supercalender as well as of the frame 31 of the calender. The figure has been simplified so that, with the exception of the system of rolls 30, the other devices included in the supercalender have been omitted in the illustration. Thus, as is shown in FIG. 2, the system of rolls 30 of the supercalender comprises an upper roll 32, a lower roll 33, as well as a number of intermediate rolls 36 placed one above the other between the upper roll and the lower roll, said rolls being arranged so that they are in nip contact with each other. In the usual way, the upper roll 32 is provided with upper cylinders 34 at each end of the roll, by means of which said cylinders 34 the system of rolls can be loaded so as to produce the desired level of linear load. In the usual way, the lower roll 33 is also provided with lower cylinders 35 at each end of the roll, by means of which said cylinders 35 the system of rolls 30 can be opened. The intermediate rolls 36 in the system of rolls, of which only one is provided with a reference numeral in FIG. 2, are mounted rotatably at both ends in bearing housings 38. Moreover, in the normal way, the system or rolls 30 is provided with lifting spindles 40 at each side of the calender frame 31. The lifting spindle 40 is suspended on the fastening bracket of the upper cylinder 34 by means of an inwardly threaded stationary nut 41 which is attached non-rotatable fashion. To the upper end of the lifting spindle 40, a drive cogwheel 42 is fixed, which is rotated by means of a switching motor 43. When the spindle 40 is rotated, it moves a certain distance upwards and downwards. The bearing housings 38 of the rolls in the system of rolls 30 are provided with brackets 39, which are fitted on the spindle 40 so as to be displaceable in the longitudinal direction of the spindle. In a conventional system of rolls, below the bracket 39 of each bearing housing 38, a spindle nut 44 is provided on the lifting spindle 40, which said nut is arranged so as to be placed at a certain distance form the bracket 39 in a normal running situation. Each spindle nut 44 is advantageously provided with an adjustable friction member, by means of which a suitable and sufficient friction is produced between the spindle nut 44 and the lifting spindle 40. Further, each spindle nut 44 is provided with a locking device 45 suspended on the bracket 39 of the bearing housing of the corresponding roll, by means of which said locking device the spindle nut 44 can be locked against rotation if necessary. When the spindle nut 44 is not locked by means of the locking device 45, it revolves along with the spindle 40 by the effect of the friction member when the lifting spindle is rotated. On the contrary, when locked, the spindle nut remains stationary while the lifting spindle 40 revolves.

In the equipment in accordance with the invention, between the brackets 39 and the spindle nuts 44 of at least one roll 36, preferably all the rolls, in the system of rolls 30 lightening devices 10 have been installed, which are described in more detail in connection with FIGS. 3 to 6.

Figure 3:
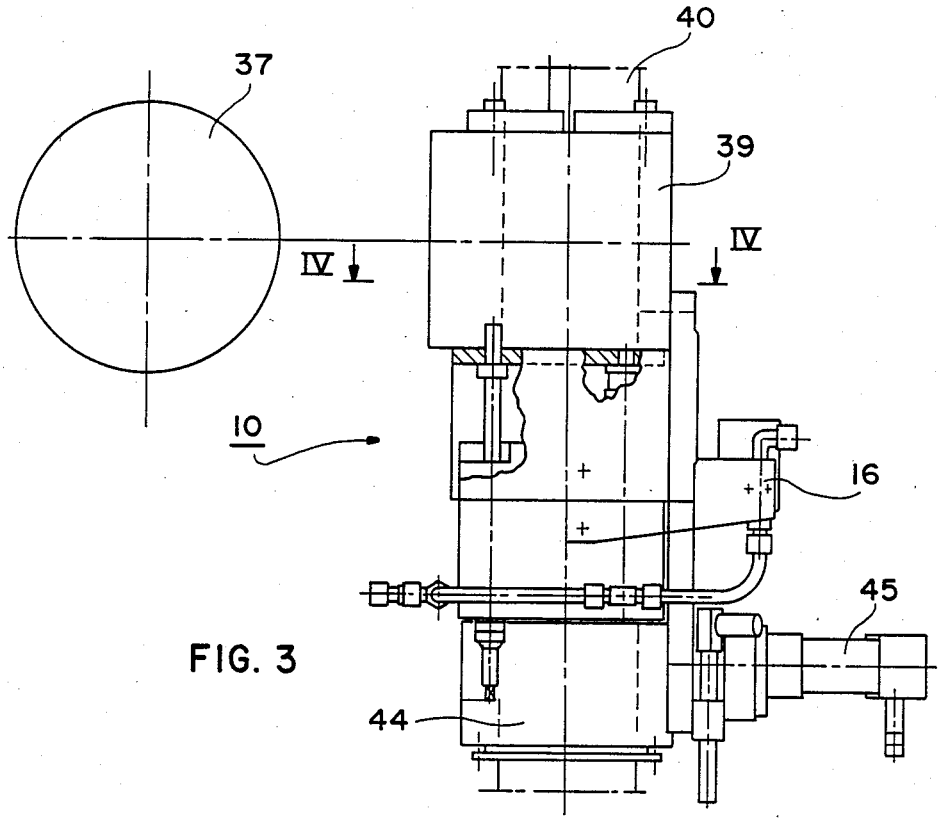
FIG. 3 is a schematical side view of one lightening device included in the equipment in accordance with the invention.
Figure 4:
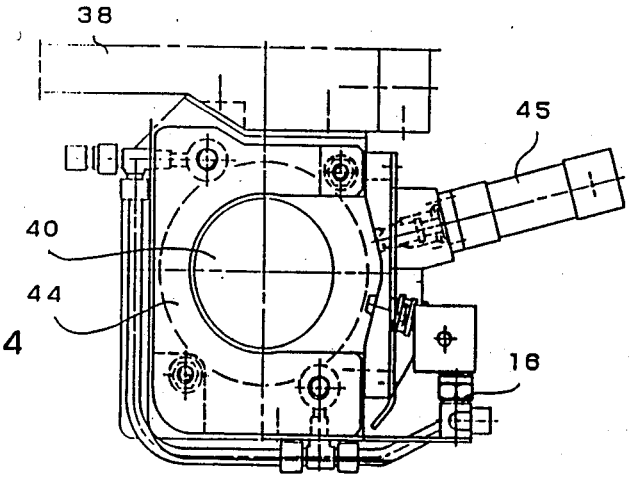
FIG. 4 is a partial sectional view along the line IV—IV in FIG. 3.

FIGS. 3 and 4 show an enlarged and simplified detail at the suspension of one roll in a system of rolls 30 in accordance with FIG. 2. In FIG. 3, the axle journal of the roll is denoted with the reference numeral 37. As can be seen clearly from FIGS. 3 and 4, the bearing housing 38 of the roll with its support is provided with a bracket 39, which is fitted slidably on the lifting spindle 40. Underneath the bracket 39, at a distance from it, a spindle nut 44 is fitted on the spindle 40, which said nut is provided with a locking device 45, as was already described above. The locking device 45 is, e.g., a dual-action pneumatic cylinder, by means of which the spindle nut 44 can be locked against rotation.

Between the bracket 39 and the spindle nut 44, a lightening device 10 in accordance with the invention is provided, which is operated by means of pressure medium. Thus, the lightening device 10 is further provided with a device 16 for the distribution of the pressure medium, by means of which said device the pressure medium can be supplied in the desired way to the actuating members of the lightening device 10. The construction and operation of the lightening device 10 are described in more detail in connection with FIGS. 5 and 6.

Figure 5:
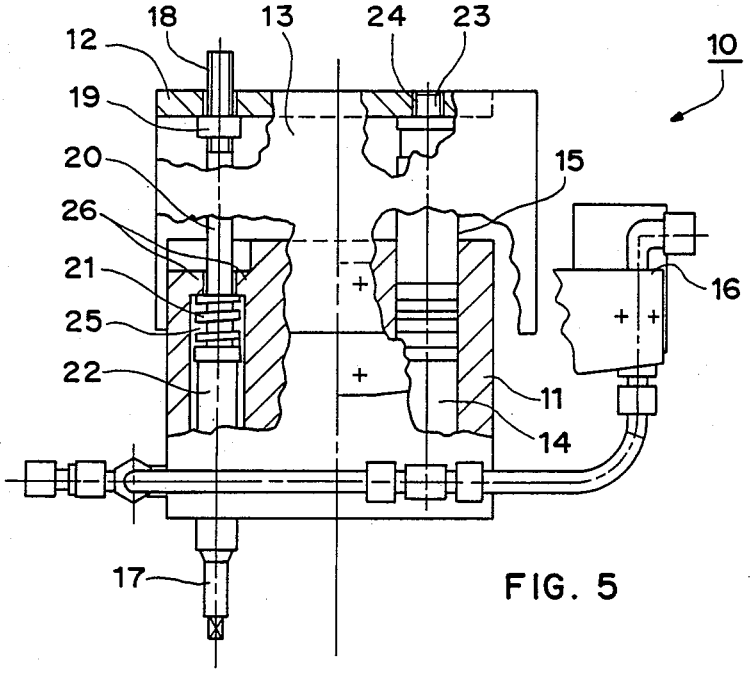
FIG. 5 is a partly sectional side view of the construction of a lightening device included in the equipment of the invention.
Figure 6:
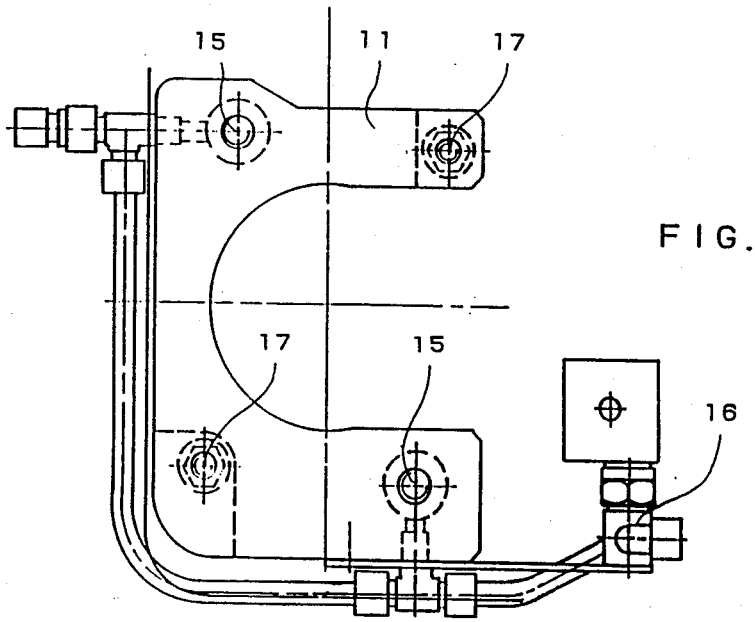
FIG. 6 is a top view of a lightening device as shown in FIG. 5.

In FIG. 5, the lightening device is denoted generally with the reference numeral 10. The lightening device 10 comprises a frame 11, which is arranged to be mounted on a spindle nut 44. Above the frame 11, a plate 12 is fitted, which reaches contact with the lower face of the bracket 39 of the bearing housing. In the frame 11 of the lightening device, pressure apparatuses are provided, whereat, by supplying pressure medium into said apparatuses, the plate 12 can be raised apart from the frame 11. The pressure apparatuses comprise cylinder bores 14 formed into the frame 11 of the lightening device at opposite sides of the lifting spindle 40, said bores 14 being closed at the lower end of the frame 11 and open at the top. Into the cylinder bores 14, pistons 15 have been fitted, which rest against the plate 12 provided above the frame 11. The top ends of the pistons 15 are appropriately provided with pins 23, which pass into holes 24 formed into the plate 12.

The pistons 15 can be made to rise upwards in the cylinder bores 14 by supplying pressure medium into the cylinder bores 14 to underneath the pistons 15. Thereby the plate 12 can be made to rise. The pressure means 14,15 are advantageously pneumatic or hydraulic, and this is why the lightening device 10 is provided with a pressure-medium distributor device 16, through which the pressure medium is supplied into said pressure means. When the pressure means are in operation, i.e. when pressure medium is being fed into the cylinder bores 14, the pistons 15 raise the plate 12 upwards, whereby the lightening device 10 raises the bracket 39 and eliminates the distortions of the profile of linear load produced by the masses of the bearing housing 38 of the roll and of any auxiliary devices attached to same.

For the purpose of rotating the lifting spindle 40, it must, however, be possible to switch off the pressure apparatus 10 and detach it from contact with the spindle nut 44. For this purpose, firstly, the pressure is discharged from the pressure means 14,15. Since the lightening device 10 is appropriately suspended on the bracket 39, discharging of the pressure from the pressure means 14,15 does not necessarily lift the lightening device apart from the spindle nut 44. In order to ensure such detaching, the lightening device 10 is, thus, provided with means that raise the lightening device 10 apart from the spindle nut 44, whereby it is possible to rotate the spindle 40. These means comprise bores 25 formed into the frame 11 of the lightening device and arranged crosswise relative the pressure apparatuses at opposite sides of the spindle 40. Into each bore 25, a screw 17 has been fitted, which extends through the frame 11 of the lightening device into the plate 12. The end of the screw spindle 20 is provided with an end threading 18, which has been turned into the hole in the plate 12, which is provided with inside threading. In order to make sure that the screw remains in the plate 12, a lock nut 19 has been additionally turned onto the end threading 18 on the spindle, said nut 19 being tightened against the lower face of the plate 12. Moreover, a bushing 22 has been fitted onto the screw 17, said bushing extending into a bore 25 formed into the frame 11 of the lightening device. The bushing 22 is attached to the screw 17 rigidly. At the upper end of the bore 25, there are shoulders 26, and a compression spring 21 is fitted between said shoulders 26 and the bushing 22. Thus, when the pressure is discharged from the pressure means 14,15, the springs 21 push the shoulders 26 and the bushings 22 at each bore 25 apart from each other and, at the same time, lift the frame 11 of the lightening device apart from the spindle nut 44. The lightening device 10 is further provided with a protection 13 attached to the plate 12 and partly extending onto the frame 11 of the lightening device and, thus, protecting the pressure apparatuses 14 and 15 of the lightening device.

The raising force of the lightening device 10 is adjusted so that the masses of the bearing housings 38 and of the auxiliary devices are neutralized. The control of the equipment is appropriately arranged as taking place directly from the logic of the calender, whereby the equipment does not require manual or external handling.

Above, the invention has been described by way of example with reference to the figures in the attached drawing. This is, however, not supposed to confine the invention to the examples shown in the figures alone, but many variations are possible within the scope of the inventive idea defined in the accompanying patent claims.

What is claimed is:

1. A supercalendar having first and second ends and comprising:

a plurality of rolls extending between the first and second ends of the supercalendar and including an upper roll, a lower roll and a plurality of intermediate rolls between the upper roll and the lower roll, a bearing housing at each end of at least one intermediate roll, a lifting spindle at each end of the supercalendar, a spindle nut in threaded engagement with each lifting spindle, the spindle nuts being mechanically coupled to the bearing housings of said one intermediate roll whereby the lifting spindles can be employed to raise and lower said one intermediate roll, a lightening device at each end of said one intermediate roll for reducing distortion in the profile of the linear load between the rolls due to the weight of the bearing housings, and a lifting device at each end of said one intermediate roll for lifting the lightening device at that end of said one intermediate roll away from the spindle nut on the spindle at that end of said one intermediate roll.

2. A supercalendar according to claim 1, comprising bracket members attached to the bearing housings respectively and extending over respective spindle nuts, and wherein each lightening device is disposed between a spindle nut and the bracket member that extends over the spindle nut for raising the bearing housing while supported on the spindle nut.

3. A supercalendar according to claim 2, wherein the lightening devices are attached to the bracket members respectively.

4. A supercalendar according to claim 3, wherein each lightening device is hydraulically operated.

5. A supercalendar according to claim 3, wherein each lightening device is pneumatically operated.

6. A supercalendar according to claim 1, wherein the lightening devices are adapted to be operated by means of a pressure medium.

7. A supercalendar according to claim 6, wherein each lightening device comprises at least one pressure cylinder.

8. A supercalendar according to claim 6, wherein each lightening device comprises two pressure cylinders arranged at opposite respective sides of a lifting spindle.

9. A supercalendar according to claim 1, wherein the lightening devices are attached to the bearing housings respectively.

10. A supercalendar according to claim 1, wherein each lifting device is mechanically operated.

11. A supercalendar according to claim 10, wherein each lifting device is spring operated.

12. A supercalendar according to claim 1, wherein each lightening device comprises a plate attached to the bearing housing, a frame between the bearing housing and the spindle nut and formed with at least one bore that extends parallel to the spindle nut and is open towards the plate, a piston member fitted slidably in the bore, and means for delivering fluid to the bore, whereby the piston member is urged into engagement with the plate and the frame is urged into engagement with the spindle nut.

13. A supercalendar according to claim 12, wherein the frame is formed with at least one passage parallel to the spindle nut, and the lifting device comprises a rod attached to the plate and extending into the passage in the frame and having a head portion, the passage in the frame having a reduced-diameter portion between the head of the rod and the plate, whereby a shoulder is defined, and the lifting device also comprises a compression spring effective between the shoulder and the head portion of the rod for urging the frame towards the plate.

* * * * *